US005661986A

United States Patent [19]

Labranque

[11] Patent Number: 5,661,986

[45] Date of Patent: Sep. 2, 1997

[54] CHEMICAL REACTOR, REFRIGERATING MACHINE AND CONTAINER PROVIDED THEREWITH AND REAGENT CARTRIDGE THEREFOR

[75] Inventor: Gilles Labranque, Le Vesinet, France

[73] Assignee: Sofrigam, France

[21] Appl. No.: 535,268

[22] PCT Filed: Apr. 5, 1994

[86] PCT No.: PCT/FR94/00377

§ 371 Date: Oct. 5, 1995

§ 102(e) Date: Oct. 6, 1995

[87] PCT Pub. No.: WO94/23253

PCT Pub. Date: Oct. 13, 1994

[30] Foreign Application Priority Data

Apr. 7, 1993 [FR] France ..... 93 04141

[51] Int. Cl.[6] ..... F25B 17/08

[52] U.S. Cl. ..... 62/480; 165/104.12

[58] Field of Search ..... 62/480, 476, 101; 165/104.12

[56] References Cited

U.S. PATENT DOCUMENTS

| | | | |
|---|---|---|---|
| 1,854,589 | 4/1932 | Keyes . | |
| 1,881,568 | 10/1932 | Henney | 62/480 |
| 2,338,712 | 1/1944 | Kleen . | |
| 2,384,460 | 9/1945 | Kleen . | |
| 2,649,700 | 8/1953 | Piper . | |
| 4,367,079 | 1/1983 | Wallsten . | |
| 4,446,111 | 5/1984 | Halene et al. . | |
| 4,609,038 | 9/1986 | Ishikawa et al. . | |
| 4,674,563 | 6/1987 | Maier-Laxhuber et al. . | |
| 4,742,868 | 5/1988 | Mitani et al. | 62/480 |
| 5,167,498 | 12/1992 | Rockenfeller | 423/299 |

FOREIGN PATENT DOCUMENTS

| | | |
|---|---|---|
| 0151786 | 8/1985 | European Pat. Off. . |
| 1029877 | 6/1953 | France . |
| 2455713 | 11/1980 | France . |
| 2508596 | 12/1982 | France . |
| 0417044 | 9/1934 | United Kingdom . |
| 2159133 | 11/1985 | United Kingdom . |

*Primary Examiner*—William Doerrler
*Attorney, Agent, or Firm*—Greer, Burns & Crain, Ltd.

[57] ABSTRACT

A reagent (26) combines exothermically with a cold refrigerating fluid exiting a refrigerating evaporator during a refrigeration cycle, then releases the refrigerating fluid endothermically once it has been heated to a sufficiently high temperature by means of a heating element (17) during a regeneration cycle during which the released refrigerating fluid condenses in a pressurized tank. The reagent is confined inside stainless steel walls (29, 31, 34) which prevent it from swelling. These walls include perforated tubes (34) lining channels (32) in which the mass exchanges take place during the combining and separating reactions. The heating element (17) is fitted in a central cavity (46). An air flow (54), which is interrupted during regeneration, evacuates the heat of the combining reaction by means of fins (56). The invention prevents the block of reagent from distorting and becoming progressively inoperative over repeated cycles.

28 Claims, 4 Drawing Sheets

CHEMICAL REACTOR, REFRIGERATING MACHINE AND CONTAINER PROVIDED THEREWITH AND REAGENT CARTRIDGE THEREFOR

DESCRIPTION

"Chemical reactor, refrigerating machine and container provided therewith, and reagent cartridge therefor"

The present invention relates to a chemical reactor for a refrigerating machine or similar.

The present invention also relates to a refrigerating machine provided therewith.

The present invention also relates to a container provided with such a refrigerating machine.

The invention also relates to a reagent cartridge.

The principle of refrigerating machines functioning by chemical reaction is known.

Starting from a reserve of refrigerating fluid in the liquid state under pressure, the fluid passes through a pressure reduction device and then an evaporator placed in the enclosure to be cooled. On leaving the evaporator, the gas is taken in by the reactor which contains a reagent which, at ambient temperature, is chemically eager for this gas. The reagent combines chemically with the gas whilst producing a certain amount of heat.

When the reserve of liquid under pressure is exhausted, the process stops and it is then necessary to initiate a regeneration process consisting of supplying heat to the chemical reactor so that the reagent chemically separates from the refrigerating gas and delivers this gas under high pressure. On leaving the reactor, the gas passes through a condenser and is then collected in the liquid state in the reserve. When the regeneration process is complete, the reserve is at its maximum level and a new refrigeration process can be initiated.

This principle which is known at present raises serious implementation problems.

In service, the reagent is subjected to high stresses, particularly those of temperature and pressure, and it must furthermore be capable of absorbing refrigerating fluid chemically and of separating from it chemically at a speed corresponding to the refrigerating fluid flow rates in the machine.

From U.S. Pat. No. 2,649,700 there is known a chemical reactor for a refrigerating machine or similar comprising several elementary blocks of reagent intended to absorb, by chemical combination, a gaseous flow coming from an evaporator and of desorbing this flow by reverse chemical reaction under the effect of a rise in temperature. The blocks, of generally annular shape, are confined between an internal wall and a peripheral wall. Furthermore, porous screens separate the elementary blocks from one another. They distribute the gaseous flow between the upper and lower surfaces of the elementary blocks and an inlet and outlet duct. A channel parallel to the axis passes through the elementary blocks and the screens and serves as a collector for the flows coming from the screens or going to them.

According to this document, the elementary blocks are made of sintered metal and are therefore dimensionally stable, particularly with respect to the above-mentioned stresses of temperature and pressure. The purpose of the walls is simply to position the blocks.

Such an absorbent material has many disadvantages: the quantity of gas which it is capable of absorbing per unit volume is relatively limited and it retains the absorbent particles badly. It is this which makes it necessary to pass the gaseous flow through screens which serve as a kind of filter but which slow down the flow and which also, in the long term, risk becoming loaded with particles trying to escape the elementary blocks. Furthermore, the necessity of providing such screens further increases the already large volume which is necessary due to the relatively poor absorption performance of the blocks themselves. Finally, as these blocks are made of metal, preferably of stainless steel, the weight of the assembly is high.

From U.S. Pat. No. 2,384,460 there is also known a reactor in which the reagent is a powder liable to swell when it absorbs the refrigerating gas. This powder is housed in a cylindrical body and is confined in a specified volume. For the transfers of mass between the absorbent material and the gas duct, the space reserved for the material is traversed by perforated tubes filled with glass wool in order to prevent the particles from escaping with the gaseous flow. The feature consisting of a filter supposed to retain the particles and to allow the gaseous flow to pass is therefore found again in a slightly different way. It will however be understood that the designer of this known device accepts that the particles will pass through the perforations of the tube. Otherwise, he would not have provided the glass wool in the tube. Consequently, there will be an increasing number of particles in the glass wool, and then, finally, in the gaseous flow itself, that is to say precisely what had not been wanted.

From EP-A-0206875 there is also known a solid reagent formed from a mixture of chloride and an expanded derivative of carbon having a laminar structure. This reagent solves the mass and heat transfer problems. It is capable of absorbing large quantities of gas per unit volume.

On the other hand, its mechanical strength is low and it has a tendency to deform rapidly under the effect of the pressure gradients and volume variations encountered during the functioning of the machine. In particular, when the reagent absorbs gas by chemical combination, its volume tends to increase progressively. Following this, the chemical separation can be incomplete and the surfaces of the reagent provided for the mass exchanges can be so deformed that they become inefficient. For example, if cavities have been provided in the block of reagent in order to increase the exchange area, these cavities tend to close in on themselves after several refrigeration-regeneration cycles.

The purpose of the invention is therefore to propose a chemical reactor for a refrigerating machine or similar which is capable of ensuring good refrigeration performance and retaining such performance over many successive cycles without prohibitive deterioration of its initial characteristics.

According to the invention, the chemical reactor for a refrigerating machine or similar comprising a block of reagent intended to absorb by chemical combination a gaseous flow coming from an evaporator and to desorb this flow by reverse chemical reaction under the effect of a rise in temperature, the block of reagent being confined between confining faces at least some of which are permeable to mass exchanges, is characterised in that the block is capable of volume variation as a function of the quantity of gas absorbed and in that the confining faces are part of confining walls capable of providing the block with shape stability in opposition to the tendency to the said volume variations.

It was in fact noticed that the reagent, despite its tendency to increase in volume during the chemical reaction of combination with the refrigerating fluid, withstood being confined in a substantially fixed volume without disadvantage. In particular it was found that this had a negligible influence on its capacity to absorb chemically a large quantity of refrigerating gas. On the contrary, the confinement stabilises the physical structure of the block, which effect is favourable for obtaining good absorption and desorption performance.

Thus, according to the invention, the block of reagent is confined in a substantially fixed volume and, as this block is solid, it has a good intrinsic cohesion in service due to which the active substance is well retained in its interior. The problems of escaping of reagent found are thus overcome with simple permeable walls, which can for example be perforated walls.

It is no longer necessary to cause the gaseous flow to pass through more or less efficient filters in order to retain particles.

Due to the invention, a reliable reactor is produced for the first time which is capable of storing quantities of gas in a restricted volume and making it possible to envisage the efficient production of cold using an absorption device. For example, unlike the absorption refrigerators known at present and which in fact are only coolers, a device according to the invention is capable of producing ice whilst being placed in a high external temperature (of tropical type) without its size or its weight exceeding usual standards.

The reactor according to the invention can receive most if not all reagents containing chlorides.

The permeable walls can for example be constituted by perforated tubes, lining parallel channels formed in the block.

During the combination reaction, it is important to extract the heat produced in order to prevent the reagent from heating up and consequently becoming less eager for the gas.

For this purpose, it is possible to secure on a peripheral wall, being one of the confining walls, cooling fins exposed to a natural or forced flow of cooling air.

On the contrary, during regeneration, it is advantageous that the heat dissipation should be as low as possible. That is why the fins are placed in an annular chamber defined externally by a heat-insulating outer casing. During refrigeration, this outer casing channels the cooling air along the fins. During regeneration, the space surrounded by the outer casing is at least partially isolated from the exterior in order to prevent convection flow along the fins.

In order to heat up the reagent during regeneration, there is preferably used an electrical resistance heating element, fitted in a housing located in the centre of the block in order that the heat produced by this element diffuses through the block with practically no losses.

If desired, it is possible to line this housing with a confining wall, but it is also acceptable not to line the housing, accepting that the substance of the block, because of its tendency to swell, should clamp the heating element. Conduction between the heating element and the block will only be better for this. It will of course be necessary to ensure the use of heating element whose surface temperature does not exceed the acceptable limit temperature for the substance of the block.

With the heating element in the center of the block and the fins at its periphery, the harmful tendency of the fins to act as a thermal diffuser during the regeneration is efficiently countered.

According to its second aspect, the invention also relates to a refrigerating machine comprising, in closed circuit, a high pressure reservoir, a pressure reduction device, an evaporator and a reactor according to the first aspect.

According to its third aspect, the invention furthermore relates to a container provided with a refrigerating machine according to the first aspect.

According to a fourth aspect, the reagent cartridge, in particular in order to become part of a reactor according to the first aspect, of a refrigerating machine according to the second aspect or of a container according to the third aspect, comprises a block of reagent enclosed in a fluid-tight casing, this block comprising cavities opening through the fluid-tight casing and closed in a fluid-tight manner by temporary obturations.

Such a cartridge allows the handling and storage of the reagent without deterioration of its properties in particular without absorption of dampness, from its manufacture until its use in the reactor.

Other features and advantages of the invention will further emerge from the following description relating to non-limitative examples.

Figure 1:
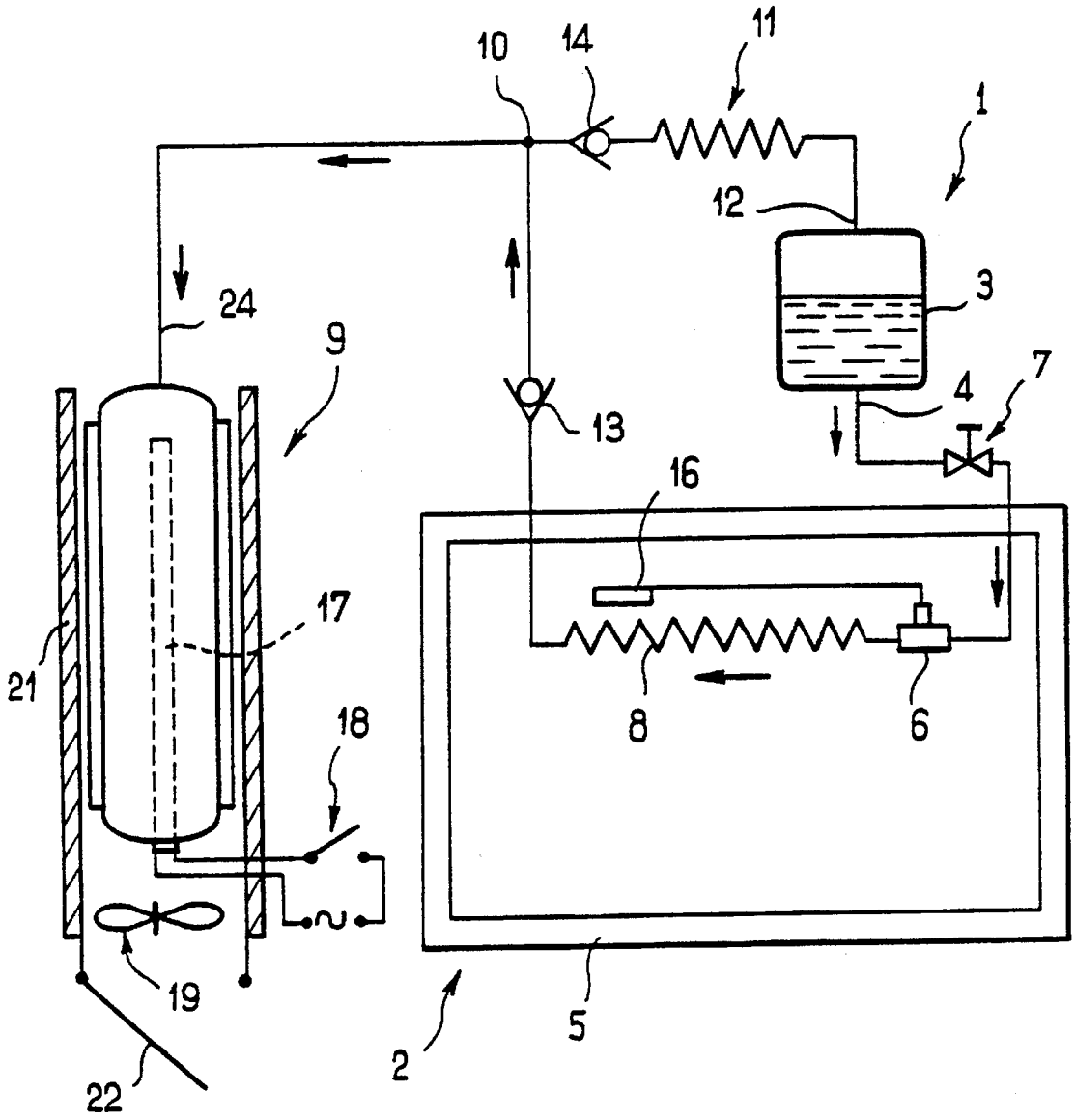
FIG. 1 is a schematic diagram of a refrigerating container according to the invention, during refrigeration.

In the example shown in FIG. 1, the refrigerating machine 1 provided for the refrigerating container 2 comprises a reserve or tank of liquid refrigerating fluid 3 subject to its own saturated vapour pressure. The fluid is, in particular, chosen such that this pressure is relatively high. In this example, this fluid is ammonia whose saturated vapour pressure is of the order of 1.5 MPa at 20° C. An outlet orifice 4, provided at the bottom of the tank 3 in order to allow only liquid to emerge, is connected to a pressure reduction device 6 by the intermediary of a stop valve which can be an electro-valve powered by a rechargeable battery attached to the container. The pressure reduction device 6 is located at the input of an evaporator 8 whose output is connected by a T connector 10 on the one hand to a reactor 9 and on the other hand to a condenser 11. The condenser 11 is itself connected to an input 12 located at the top of the tank 3.

The pressure reduction device 6 and the evaporator 8 are located inside the heat-insulated enclosure 5 of the refrigerating container 2 whilst the other elements described up to this point are located outside of the enclosure 5. A non-return valve 13 prevents the fluid coming from the reactor 9 from flowing in the direction of the evaporator 8, whilst another non-return valve 14 prevents the fluid contained in the tank 3 from flowing towards the condenser 11.

An overheating measurement device 16, of known type, controls the degree of opening of the pressure reduction device 6 such that the fluid emerging from the evaporator 8 is completely evaporated without being excessively overheated.

In a way which will be described in greater detail below, the reactor 9 contains a reagent, preferably that known from EP-A-0477343/WO-A-9115292 constituted by a mixture of chloride and an expanded carbon derivative with laminar structure, having the property of combining chemically with the refrigerating fluid used, ammonia in this instance, when its temperature is low, and of being chemically separated from the ammonia when its temperature assumes a predetermined high value.

That is why the reactor 9 comprises means for selectively allowing it to be heated or cooled. The means of heating it essentially comprise a heating element 17 which is selectively actuated by a switch 18. In a manner which is not shown, the heating element can be thermostat controlled. The means of cooling the reactor 9 comprise a fan 19 powered by the rechargeable battery attached to the container. The fan 19 causes a convection air flow to circulate inside an outer casing 21 of the reactor. The casing 21 is heat-insulating in order to limit heat losses during the heating and comprises, at its base, a flap 22 which is closed during the heating in order to prevent the chimney effect. On the contrary, the flap 22 is open while the fan 19 is operating.

The general functioning of the refrigerating machine shown in FIGS. 1 and 2 will now be described.

When the machine is waiting to operate as a refrigerator, the stop valve 7 is closed such that the reserve of refrigerating fluid is trapped between the non-return valve 14 and the valve 7. Its pressure is high since it corresponds to the saturated vapour pressure of ammonia at the external temperature, for example 20° C.

In order to initiate a refrigeration cycle, it suffices to open the stop valve 7 and the flap 22, and to cause the fan 19 to operate. The liquid leaves the tank 3 through the outlet 4 and the valve 7, and then passes through the pressure reduction device 6 whilst losing pressure, which allows it to vaporise in the evaporator 8 whilst extracting the necessary latent heat of vaporization from the cold chamber of the container. The gas thus formed passes through the non-return valve 13 in the forward flow direction and then reaches the reactor 9 where, considering the low temperature maintained by the fan 19, the gas chemically combines with the reagent. The refrigerating effect disappears when the reagent is substantially saturated by the ammonia, the tank 3 being then at its low level.

Figure 2:
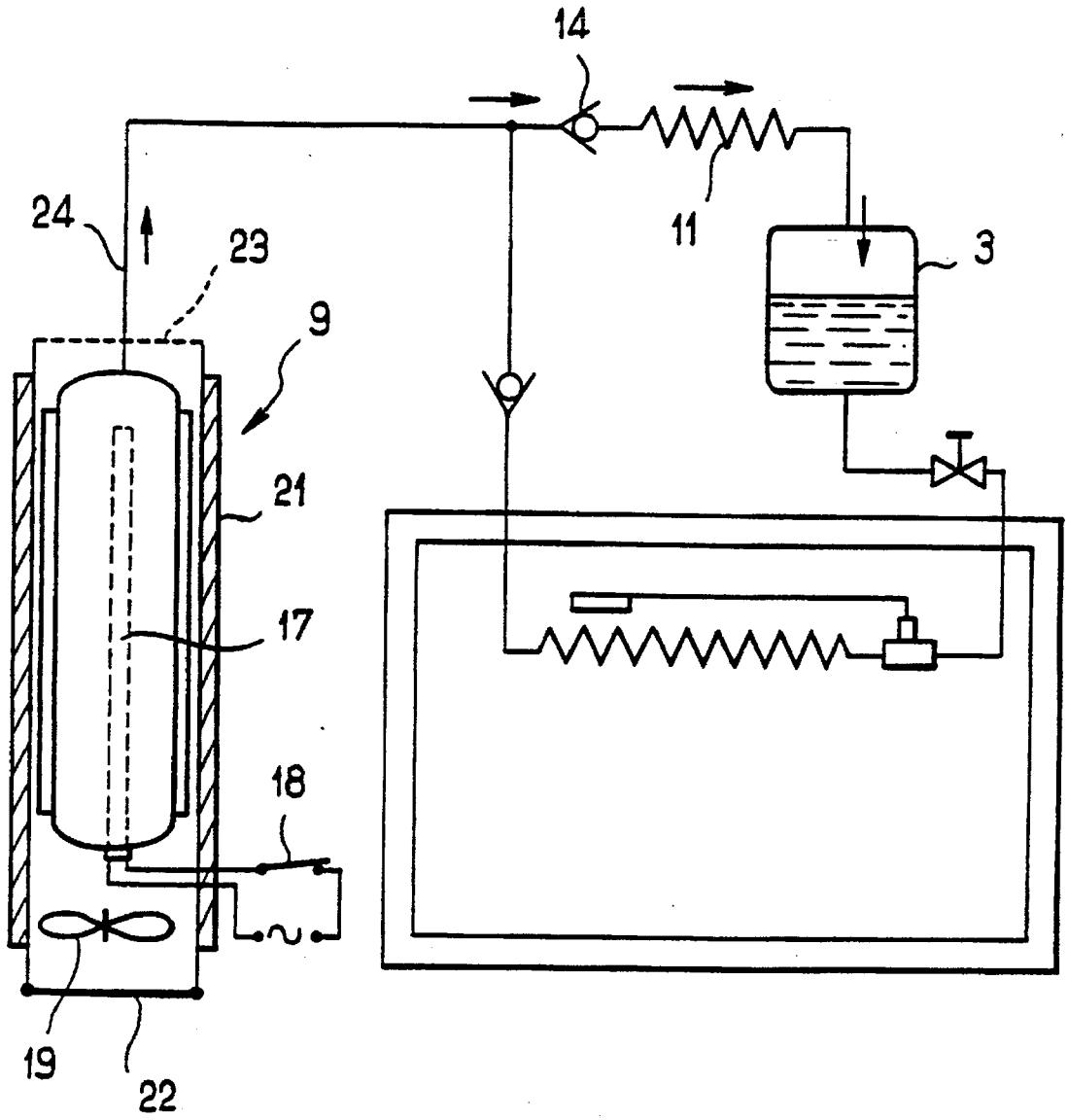
FIG. 2 is a view similar to FIG. 1 but during regeneration.

It is then necessary to proceed to a regeneration cycle, as shown in FIG. 2. For this purpose, the valve 7 and the flap 22 are closed, operation of the fan 19 is interrupted and the heating element 17 is brought into operation using the switch 18. Provision can also be made to close the upper end of the casing 21 by means, for example, of an obturator 23.

The heating of he reagent by the element causes separation of the ammonia which leaves in the gaseous state through the same pipe 24 as that through which it was brought into the reactor. Considering the relatively high temperature in reactor, the pressure of the gas leaving it tends to be higher than the equilibrium temperature in the tank 3 such that the gas passes through the non-return valve 14. It is then returned to the ambient temperature, such as 20° C., in the condenser 11 in order to return to the liquid state in the tank 3. When the reagent is rid of almost all of the mobile ammonia (after putting into service, a certain quantity of ammonia remains permanently trapped in the block), the regeneration cycle stops. A new refrigeration cycle can begin. The tank 3 is then at its high level.

Such a container has the advantage of being able to undergo the regeneration process when it is in store, and may then be autonomous in energy in order to ensure the refrigeration of foodstuffs contained in the container during the transport of the container.

The reactor 9 will now be described in detail with reference to FIGS. 3 and 4.

The block of reagent 26 has a generally cylindrical shape having the same axis 27 as the casing 21 and a diameter less than the internal diameter of the casing 21.

In the example shown, the block 26 consists of a stack of elementary disk-shaped blocks 28.

According to the invention, the block 26 is enclosed in confining walls which are preferably made of stainless steel in order to be mechanically strong and to resist corrosion.

The confining walls comprise, in particular, a cylindrical casing 29 into which the elementary blocks 28 are fitted such that they are lightly clamped initially. This clamping is intended to increase after the reactor is used because of the tendency of the reagent to swell as explained above. The casing 29 therefore has a function of hooping the block 26.

The peripheral casing 29 is closed at each axial end of the block 26 by a closure plate 31 of circular shape. The block 26 is traversed by a certain number (four in the example) of channels 32 of cylindrical shape, which are parallel with the axis 27 and distributed angularly around the latter. The channels 32 coincide with openings 33 formed through the plates 31 and thus emerge on the outside of the confining casing of the block 26. The channels 32 are surrounded by permeable confining walls consisting of perforated tubes made of stainless steel 34. The perforations of the tubes 34 allow mass exchanges between the gaseous medium of the channels 32 and the block 26 which is exposed to this medium though the perforations. The annular ends of the perforated tubes 34 are contiguous with the corresponding peripheries of the openings 33.

In each of the two annular regions where the outer casing 29 is connected to one of the confining plates 31, the outer casing 29 is also connected in a fluid-tight manner to an upper closure cap 36 and to a lower closure cap 37 respectively. An upper cross-piece 38 and a lower cross-piece 39 respectively are fitted in a substantially central position between each cap, 36 or 37 respectively, and the adjacent confining plate 31.

A distribution and collecting chamber 41 is defined between the upper cap 36 and the adjacent confining plate 31 and consequently is connected to the channels 32 through the openings 33. The upper cross-piece 38 comprises ducts 42 which connect the collection and distribution chamber 41 with the inlet and outlet duct 24 in the reactor 9, through a bore 43 in the upper cap 36 and an inlet and outlet orifice 44 in the reactor. The lower cap 37 and the corresponding confining plate 31 together define a circulation chamber 50.

The heating element 17 is an electrical element in the form of a rod whose useful length corresponds to the axial length of the block 26 and which is fitted substantially with no play in an axial housing 46 provided through the whole axial length of the block 26. The upper end of the housing 46 is closed by the plate 31 adjacent to the chamber 41. According to a first embodiment shown in the left hand section of FIG. 3, the housing 46 is not lined so that, in operation, the reagent, taking account of its tendency to swell, clamps the heating element 17 with the advantage of improving the thermal contact between them.

Figure 3:
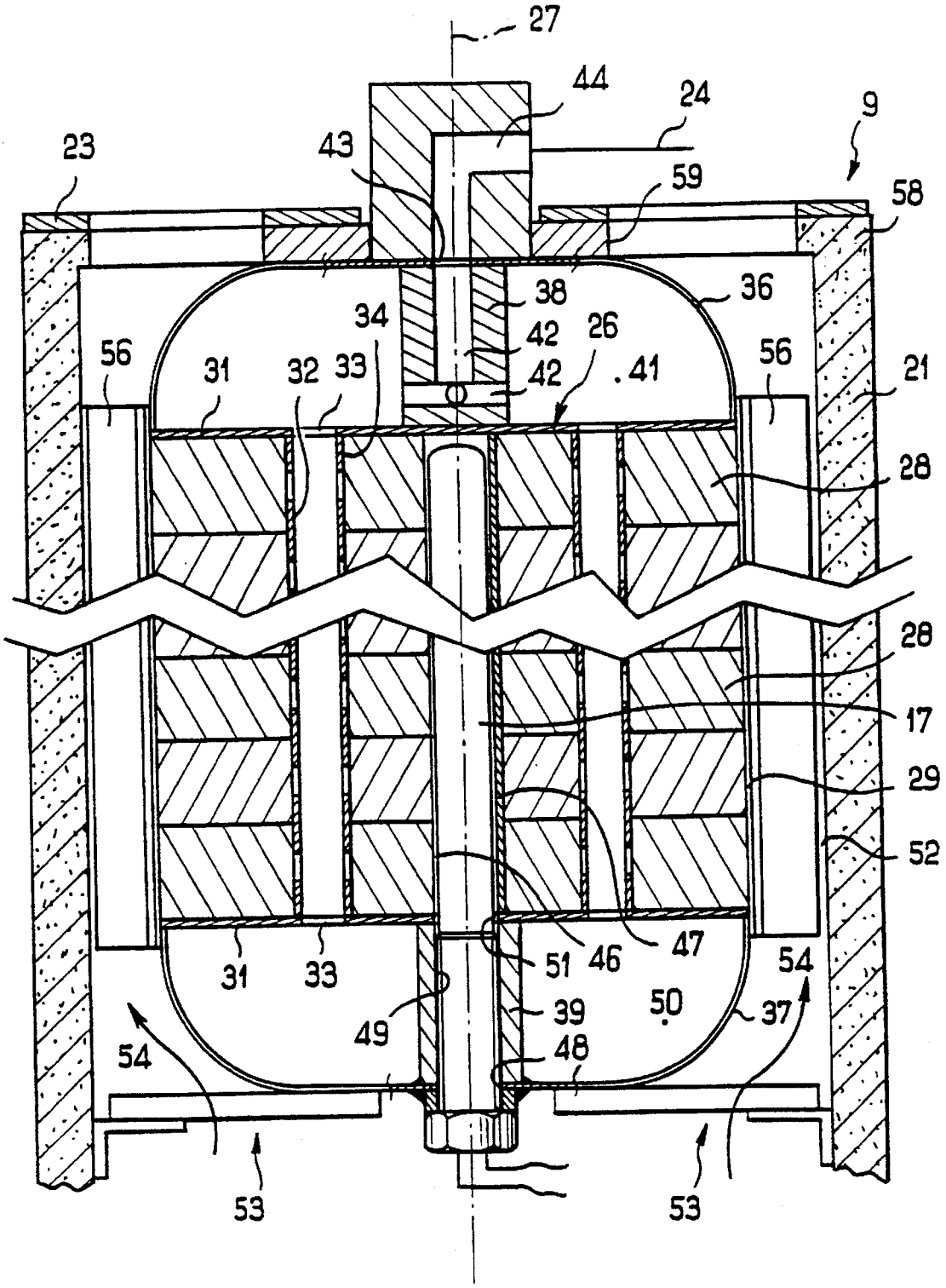
FIG. 3 is an axial cross-section view of the reactor of FIGS. 1 and 2.
Figure 4:
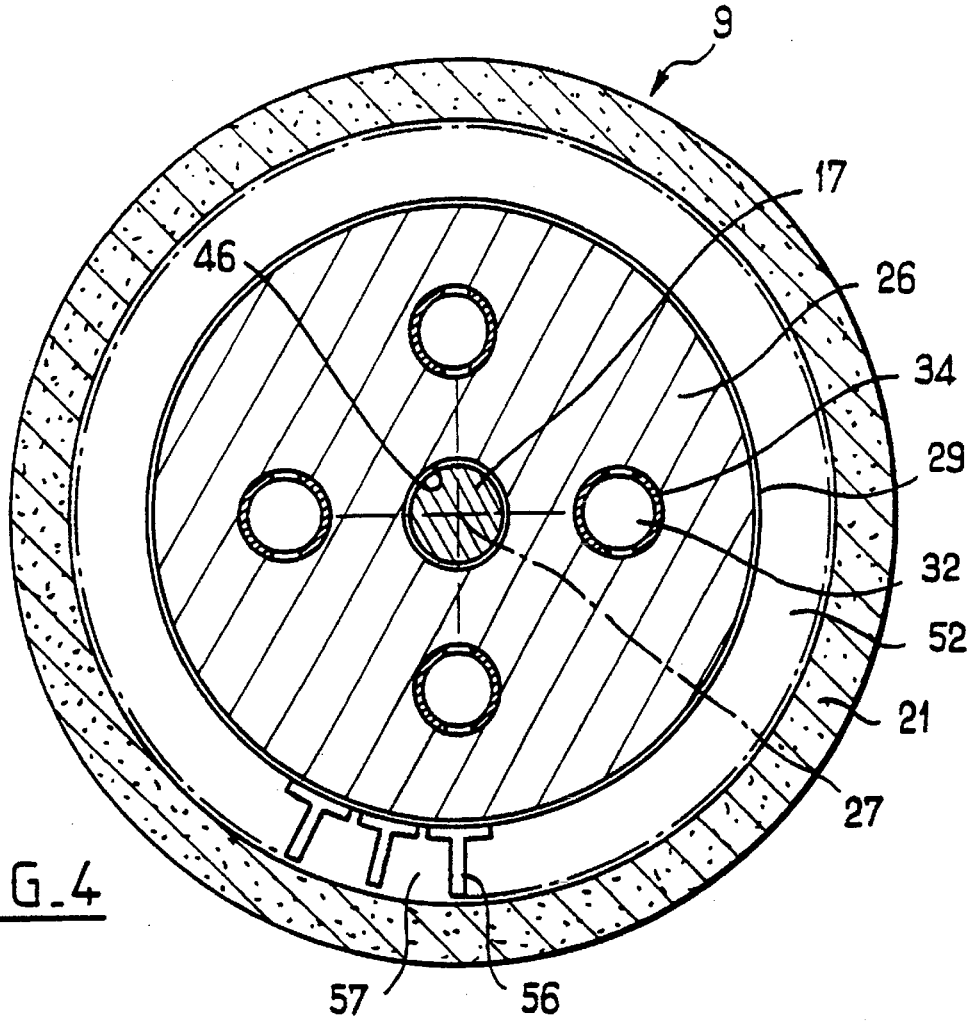
FIG. 4 is a transverse cross-section view of the reactor of FIGS. 1 and 2.

On the other hand, as shown in the right hand section of FIG. 3, if it is feared that the temperature of the heating element 17 may damage the surrounding reagent, it is also possible to line the housing 46 with a tube 47. If the latter is impermeable, in particular not perforated, it protects the heating element 17 from corrosion.

The heating element is fitted through a bore 48 in the lower cap 37 and a central bore 49 in the lower cross-piece 39. The latter therefore serves as a mounting for the heating element 17. It can for example be threaded internally in order to receive a corresponding thread of the element 17 for the purpose of fixing it. The lower confining plate 31 has a central opening 51 to allow the element 17 to pass through.

In order to prevent leakages of ammonia to the exterior, the peripheral casing 29 is fluid-tight and it is connected in a fluid-tight manner to the upper 36 and lower 37 caps. The latter are also fluid-tight, with the exception of their respective bores 43 and 48, which are connected in a fluid-tight manner with the internal passages 42 and 49 of their respective cross-pieces 38 and 39, as well as, in the case of the upper cap 36, with the orifice 44 provided for connection with the rest of the refrigeration circuit. The heating element 17 is fitted in a fluid-tight manner in the bore 49.

The peripheral wall 29 and the outer casing 21 between them define an annular chamber 52 intended for the rising circulation of the cooling air flow produced by the fan 19 (not shown in FIG. 3) which is below the lower cap 37. The assembly constituted by the reagent block 26, the confining walls 29, 31, 32 and the caps 36 and 37 together with the heating element 17 is supported inside the outer casing 21 by any appropriate means such as brackets 53 allowing the passage of the air flow 54.

The peripheral wall 29 carries fins 56 protruding into the annular chamber 52 towards the outer casing 21. The fins 56 are disposed in axial planes in such a way as to define between them air circulation channels 57 (FIG. 4) parallel with the axis 27. The fins 56 are, for example, made from sections of T-shaped aluminium profile welded to the external surface of the peripheral casing 29.

At its upper end, the outer casing 21 is closed by a wall 58 with openings, whose openings 59 can be closed selectively by an obturating disk forming the obturator 23 shown schematically in FIG. 2.

The functioning of the reactor 9 is as follows:

while it is functioning in refrigeration, the gaseous ammonia, cold and pressure-reduced, reaches through the orifice 24 the distribution and collection chamber 41 and then the channels 32 before being absorbed by chemical combination with the reagent 26 through the perforations in the confining tubes 34. The flap 22 is open, as shown in FIG. 1, and the obturator 23 is also in the open position, as shown in FIG. 3. The fan 19 operates and generates the cooling air flow 54 which removes the heat of the exothermic combination reaction. The flow 54 is accelerated by the chimney effect inside the outer casing 21, because of the temperature of the fins 56 which are heated up by the reaction heat.

During regeneration, the operation of the fan 19 is interrupted, the flap 22 and the obturator 23 are closed and the heating element 17 is put into operation in order to bring the reagent up to a temperature which can be of the order of 200° C. This results in an endothermic chemical separating reaction between the reagent and the ammonia, which is released in the gaseous state through the perforations of the tubes 34 and then through the inlet and outlet orifice 44, via the distribution and collection chamber 41 and the ducts 42 of the cross-piece 38.

As the annular chamber 52 is isolated from the exterior at this stage, the fins 56 no longer take any part in heat evacuation, so that the endothermic reaction takes place with a good yield.

The confining plates 31, even though flat, effectively resist the tendency of the block to swell as they are adjacent to the chambers 41 and 50 in which the pressure of the gaseous ammonia exists.

The strength of the plates 31 is increased by the connection between them provided by the perforated tubes 34 and (if provided) the non-perforated tube 47, and also by the cross-pieces 38 and 39 which transfer the swelling thrust to the caps 36 and 37 which are strong because of their domed shape. This reinforcement provided to the plates 31 is useful when the pressure in the chambers 41 and 50 is low whilst the swelling tendency of the block is at a maximum, for example at the end of a refrigeration cycle.

Figure 5:
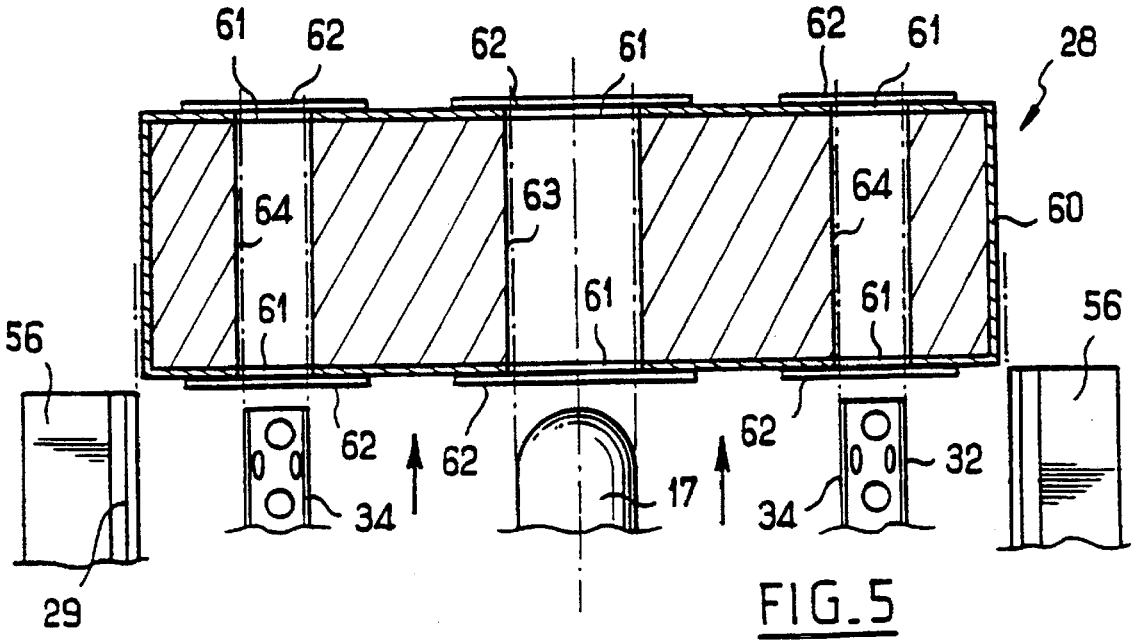
FIG. 5 is a partial view of a variant embodiment.

In the embodiment shown in FIG. 5, the elementary blocks 28 are prefabricated cartridges having their own outer casing 60 which is fluid-tight apart from the openings 61 for the passage of the perforated tubes 34 and the heating element 17.

The casing 60 has a simple sealing and mechanical cohesion function but it is not designed to withstand the operational pressure.

When manufacturing the cartridges, the openings 61 are obturated with frangible fluid-tight obturators 62 made, for example, from fluid-tight paper. During assembly, the peripheral wall 29, the lower cap, the lower confining plate 31, the lower cross-piece 39, the perforated tubes 34 and the heating element 17 are assembled first, then the elementary blocks 28 are stacked inside the peripheral wall 29 whilst the heating element 17 and the tubes 34 each perforate two obturators 62 of each block when they enter into and emerge from the bore 63 or 64 respectively. The bores 63 and 64 are not lined. The function of the obturators 62 is to protect the block from unwanted absorption of dampness before it is assembled.

The assembly of the core of the reactor is completed by the putting into position of the plate 31 and of the upper cap 36.

The embodiment shown in FIG. 5 simplifies the assembly of the reactor by transferring a certain number of precautions, in particular hygrometric ones, to the manufacture of the blocks alone.

The invention is of course not limited to the examples described and shown.

The plates 31 could also be perforated in order to increase the mass exchange areas.

It would be possible to close only the top or the bottom of the outer casing in order to interrupt the cooling air flow during regeneration.

It would be possible for there to be several cross-pieces in each chamber and several heating elements in the block.

The reactor could have two different points of access, one for the input of ammonia during refrigeration and the other for the output of ammonia during regeneration.

I claim:

1. A chemical reactor for a refrigerating machine including a supply of reagent intended to absorb by chemical combination a gaseous flow coming from an evaporator and to desorb this flow by reverse chemical reaction under the effect of a rise in temperature, the reagent being confined between confining faces at least some of which are permeable to mass exchanges, characterized in that the reagent is formed as at least one solid block of reagent prior to its installation in the reactor between said confining faces so that said block is capable of volume variations as a function of the quantity of gas which it has absorbed, and in that the confining faces are part of confining walls configured to exert an initial light clamping force upon said at least one block which is capable of providing the block with shape stability for resisting said volume variations.

2. A reactor according to claim 1, characterized in that the permeable confining walls are perforated walls interposed between the substance of the block and a space for circulation of the gaseous flow.

3. A reactor according to claim 1, characterized in that the permeable walls are tubes which line recesses formed in the block.

4. A reactor according to claim 3, characterized in that the recesses are channels parallel with one another.

5. A reactor according to claim 3, characterized in that, at at least one of their ends, the recesses open in a chamber adjacent to one of two opposite faces of the block of reagent.

6. A reactor according to claim 5, characterized in that the chamber is separated from the block by a confining plate which is one of the confining walls of the block and through which the recesses open.

7. A reactor according to claim 6, characterized in that the chamber adjacent to one of the ends of the block is connected with an orifice for connection with a refrigeration circuit.

8. A reactor according to claim 6, characterized in that at least one cross-piece extends between the confining plate and an opposite wall also delimiting the chamber.

9. A reactor according to claim 8, characterized in that in the cross-piece there is formed a passage connecting the chamber with a refrigeration circuit.

10. A reactor according to claim 8, characterized in that the cross-piece is hollow and allows the passage and fixing of a heating element engaged in a cavity formed in the block of reagent and opening through the confining plate opposite the cross-piece.

11. A reactor according to claim 4, characterized in that the channels are distributed around a cavity formed in a substantially central position in the block and accommodate a heating element.

12. A reactor according to claim 1, characterized in that the block comprises a cavity in which a heating element is mounted.

13. A reactor according to claim 10, characterized in that the heating element is fitted substantially without play in the cavity, which is delimited by surfaces which are part of the block of reagent.

14. A reactor according to claim 10, characterized in that the housing is delimited by one of the confining walls.

15. A reactor according to claim 6, characterized in that the confining plate is connected by its periphery to a peripheral hooping casing of the block, being one of the said confining walls.

16. A reactor according to claim 15, characterized in that, in the region in which the confining plate is connected to the peripheral casing, the confining walls are connected to the peripheral edge of an end cap.

17. A reactor according to claim 1, characterized in that the block is of cylindrical shape and the confining walls comprise a peripheral hooping casing.

18. A reactor according to claim 1, characterized in that the confining walls comprise a peripheral casing carrying cooling fins protruding into an annular chamber contained between the peripheral casing and an outer casing.

19. A reactor according to claim 18, characterized in that the fins are oriented in such a way as to define between them parallel air circulation channels, preferably vertical.

20. A reactor according to claim 18, characterized by means for selectively providing and preventing the circulation of air in the annular chamber.

21. A reactor according to claim 18, characterized in that the outer casing is heat-insulated.

22. A reactor according to claim 18, characterized in that the confining walls are made of stainless steel and the fins are made of aluminum.

23. A reactor according to claim 18, characterized in that the fins are formed from sections of profiled material fixed to the peripheral casing.

24. A reactor according to claim 15, characterized in that the block is fired such that it is lightly clamped in the peripheral casing.

25. A reactor according to claim 1, characterized in that the block comprises a plurality of disk-shaped elementary blocks slipped in stacked fashion one after the other into a space defined by said confining walls.

26. A refrigerating machine, including in a closed circuit, a high pressure reservoir, a pressure reduction device and a chemical reactor for a refrigerating machine having a supply of reagent intended to absorb by chemical combination a gaseous flow coming from an evaporator and to desorb this flow by reverse chemical reaction under the effect of a rise in temperature, the reagent being confined between confining faces at least some of which are permeable to mass exchanges, characterized in that the reagent is formed as at least one solid block of reagent prior to its installation in the reactor between said confining faces so that said block is capable of volume variations as a function of the quantity of gas which it has absorbed, and in that the confining faces are part of confining walls configured to exert an initial light clamping force upon said at least one block which is capable of providing the block with shape stability for resisting said volume variations.

27. A container provided with a refrigerating machine including in a closed circuit, a high pressure reservoir, a pressure reduction device and a chemical reactor for a refrigerating machine having a supply of reagent intended to absorb by chemical combination a gaseous flow coming from an evaporator and to desorb this flow by reverse chemical reaction under the effect of a rise in temperature, the reagent being confined between confining faces at least some of which are permeable to mass exchanges, characterized in that the reagent is formed as at least one solid block of reagent prior to its installation in the reactor between said confining faces so that said block is capable of volume variations as a function of the quantity of gas which it has absorbed, and in that the confining faces are part of confining walls configured to exert an initial light clamping force upon said at least one block which is capable of providing the block with shape stability for resisting said volume variations.

28. A reagent cartridge, in particular for being part of a reactor for a refrigerating machine including a supply of reagent intended to absorb by chemical combination a gaseous flow coming from an evaporator and to desorb this flow by reverse chemical reaction under the effect of a rise in temperature comprising, said reagent being formed as at least one solid block prior to its installation in the reactor, said at least one block being configured for confinement between confining faces at least some of which are permeable to mass exchanges, said at least one block being capable of volume variations as a function of the quantity of gas which it has absorbed and in that the confining faces are part of confining walls configured to exert an initial light clamping force upon said at least one block which is capable of providing the block with shape stability which resists said volume variations; and said at least one block of reagent being enclosed in a fluid-tight casing, said block having cavities emerging through the fluid-tight casing and closed in a fluid-tight manner by temporary obturations.

* * * * *